US007188925B2

(12) United States Patent
Wood, III et al.

(10) Patent No.: US 7,188,925 B2
(45) Date of Patent: Mar. 13, 2007

(54) FLUID EJECTION HEAD ASSEMBLY

(75) Inventors: Benjamin H. Wood, III, San Diego, CA (US); Joseph E. Scheffelin, Poway, CA (US); Noah Lassar, San Diego, CA (US); Mohammad Akhavain, Escondido, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 296 days.

(21) Appl. No.: 10/769,429

(22) Filed: Jan. 30, 2004

(65) Prior Publication Data

US 2005/0168513 A1 Aug. 4, 2005

(51) Int. Cl.
*B41J 2/015* (2006.01)

(52) U.S. Cl. ..... 347/20; 347/40; 347/41; 347/49

(58) Field of Classification Search ..... 347/20, 347/40–42, 49

See application file for complete search history.

(56) References Cited

U.S. PATENT DOCUMENTS

| | | | | |
|---|---|---|---|---|
| 4,942,408 | A * | 7/1990 | Braun | 347/63 |
| 5,027,134 | A | 6/1991 | Harmon et al. | |
| 5,498,306 | A | 3/1996 | Shibata | |
| 6,068,364 | A | 5/2000 | Kusumi et al. | |
| 6,168,255 | B1 | 1/2001 | Nagashima | |
| 6,302,512 | B1 | 10/2001 | Ikegame | |
| 6,471,330 | B1 | 10/2002 | Umeda et al. | |
| 6,481,826 | B1 | 11/2002 | Hara et al. | |
| 2002/0027577 | A1 * | 3/2002 | Sugiyama et al. | 347/65 |
| 2002/0093552 | A1 | 7/2002 | Yamamoto | |
| 2004/0001117 | A1 | 1/2004 | Choy et al. | |
| 2004/0021729 | A1 * | 2/2004 | Verlinden et al. | 347/40 |

FOREIGN PATENT DOCUMENTS

| | | |
|---|---|---|
| EP | 0 995 601 | 4/2000 |
| EP | 1 179 430 | 2/2002 |
| EP | 1177897 A1 * | 2/2002 |
| WO | WO 03/070471 | 8/2003 |

* cited by examiner

*Primary Examiner*—Stephen Meier
*Assistant Examiner*—Ly Tran

(57) ABSTRACT

A fluid ejection head of a fluid ejection device is provided, the fluid ejection head having a substrate, a fluid ejection die coupled with the substrate, an electromagnetic radiation-curable adhesive disposed on the substrate, and a cover coupled with the substrate via the electromagnetic radiation-curable adhesive, wherein the cover includes an opening configured to pass fluids ejected from the fluid ejection die, and wherein the cover is made at least partially of a material transparent to electromagnetic radiation.

13 Claims, 4 Drawing Sheets

FLUID EJECTION HEAD ASSEMBLY

BACKGROUND

Fluid ejection devices may find uses in a variety of different technologies. For example, some printing devices, such as printers, copiers and fax machines, print by ejecting tiny droplets of a fluid from an array of fluid ejection mechanisms onto a printing medium. The fluid ejection mechanisms are typically formed on a fluid ejection die mounted to a carrier that is movably coupled to the body of the printing device. Careful control of the individual fluid ejection mechanisms, the movement of the die across the printing medium, and the movement of the medium through the device allow a desired image to be formed on the medium.

The combination of the fluid ejection die and the carrier may be referred to as a "fluid ejection head." One type of fluid ejection device, commonly referred to as a wide-array fluid ejection device, includes a fluid ejection head having a plurality of fluid ejection dies mounted on a single carrier. This allows the wide array fluid ejection device to eject more fluid droplets per unit time compared to a single-die fluid ejection head, and thus helps to increase printing speeds.

Many fluid ejection devices employ a servicing station to periodically wipe (or otherwise clean) the fluid ejection head of any fluid residues. Servicing stations typically include a flexible wiper that is wiped across the surface of the printhead on which the orifices are located, thereby pushing any residual fluid away from the orifices and helping to prevent contamination of the orifices with the residues. However, the fluid ejection dies of some fluid ejection devices may stand proud of the surface of the carrier. Where the upper surfaces of the die and the carrier are not level, the wiper may miss some ink residues adjacent where the carrier and die meet. Moreover, the die and the carrier are often made of semiconductor and/or ceramic materials, and thus may have rough edges and/or surfaces capable of damaging the wiper.

DETAILED DESCRIPTION

Figure 1:
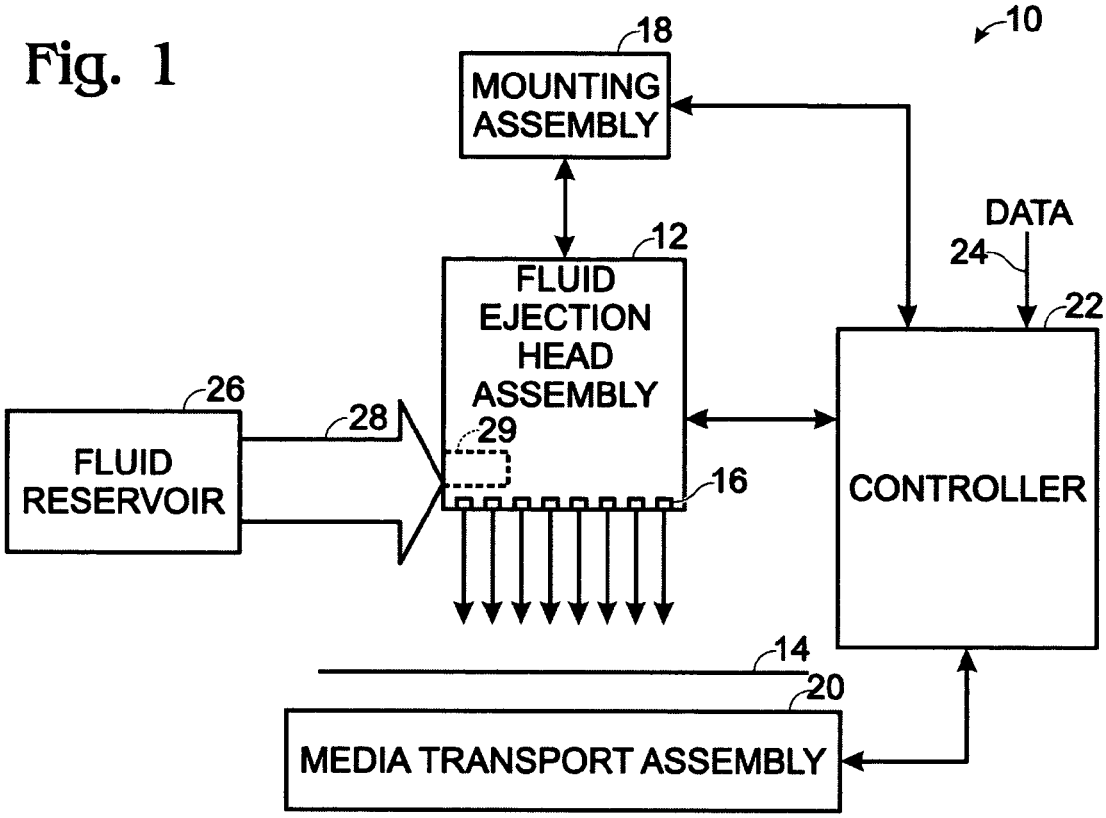
FIG. 1 is a block diagram of an exemplary printing system in which a fluid ejection device according to embodiments of the present invention may be utilized.

FIG. 1 shows, generally at 10, a block diagram of an exemplary printing system in which a fluid device according to embodiments of the present invention may be utilized.

Fluid ejection device 10 may be any suitable type of fluid ejection device, including, but not limited to, a printing device such as a printer, facsimile machine, copier, or a hybrid device that combines the functionalities of more than one of these devices. Fluid ejection device 10 includes a fluid ejection head assembly 12 configured to transfer a fluid onto a printing medium 14 positioned adjacent to the fluid ejection head assembly. Fluid ejection head assembly 12 typically is configured to transfer the fluid onto printing medium 14 via a plurality of fluid ejection mechanisms 16. Fluid ejection mechanisms 16 may be configured to eject fluid in any suitable manner. Examples include, but are not limited to, thermal and piezoelectric fluid ejection mechanisms.

Fluid ejection head assembly 12 may be mounted to a mounting assembly 18 configured to move the fluid ejection head assembly relative to printing medium 14. Likewise, printing medium 14 may be positioned on, or may otherwise interact with, a media transport assembly 20 configured to move the printing medium relative to fluid ejection head assembly 12. Typically, mounting assembly 18 moves fluid ejection head assembly 12 in a direction generally orthogonal to the direction in which media transport assembly 20 moves printing medium 14, thus enabling printing over a wide area of printing medium 14. Alternatively, the mounting assembly 18 may hold one or more type of fluid ejection head assembly 12 in a fixed location relative to the media transport assembly 20 while the medium 14 is moved to enable wide area coverage.

Fluid ejection device 10 also typically includes an electronic controller 22 configured to receive data 24 representing a print job. Controller 22 may also be configured to control the ejection of fluid from fluid ejection head assembly 12, the motion of mounting assembly 18, and the motion of media transport assembly 20 to effect printing of an image represented by data 24.

Fluid ejection device 10 also typically includes a fluid supply or reservoir 26 configured to supply fluid stored within the fluid reservoir to fluid ejection head assembly 12 as needed. Fluid reservoir 26 is fluidically connected to fluid ejection head assembly 12 via a conduit 28 configured to transport fluid from the fluid reservoir to the fluid ejection head assembly. Any of fluid ejection head assembly 12, fluid reservoir 26, or conduit 28 may include a suitable pumping mechanism (not shown) for effecting the transfer of fluid from the fluid reservoir to the fluid ejection head assembly. Examples of suitable pumping devices include, but are not limited to, peristaltic pumping devices.

Fluid reservoir 26 may be configured to deliver fluid to fluid ejection head assembly 12 continuously during printing, or may be configured to deliver a predetermined volume of fluid to the fluid ejection head assembly periodically. Where fluid reservoir 26 is configured to deliver a predetermined volume of fluid to fluid ejection head assembly 12 periodically, the fluid ejection head assembly may include a smaller reservoir 29 configured to hold fluid transferred from fluid reservoir 26.

Figure 2:
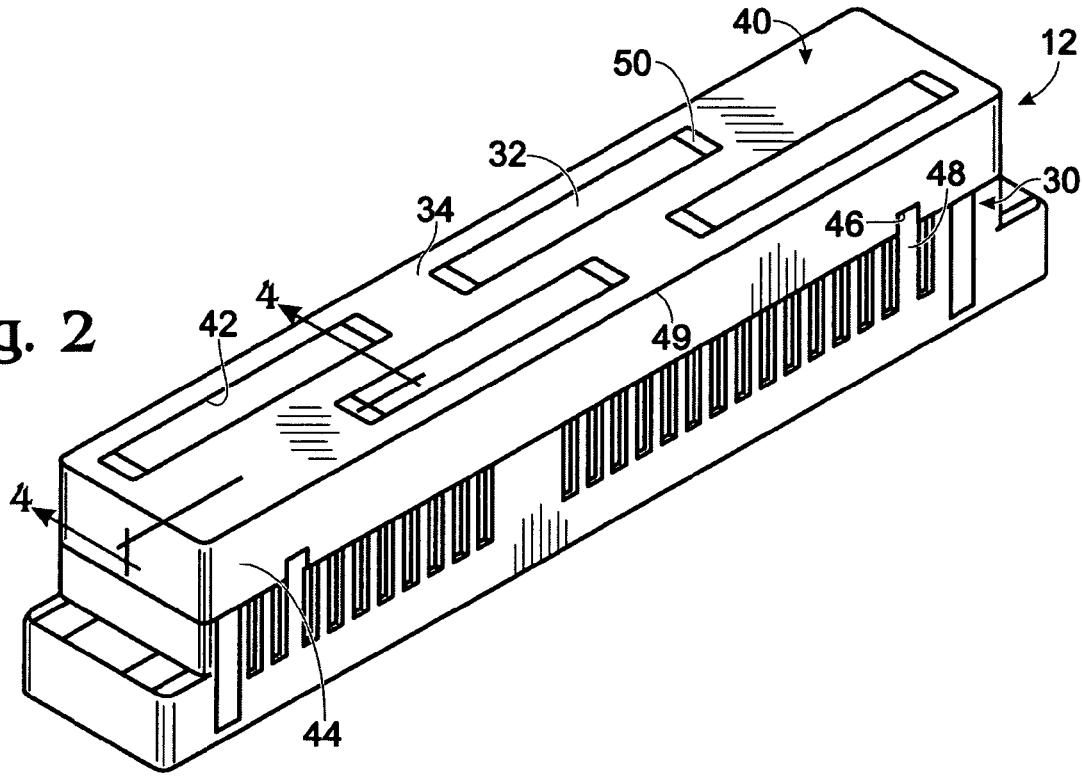
FIG. 2 is an isometric view of a fluid ejection head according to an embodiment of the present invention.
Figure 3:
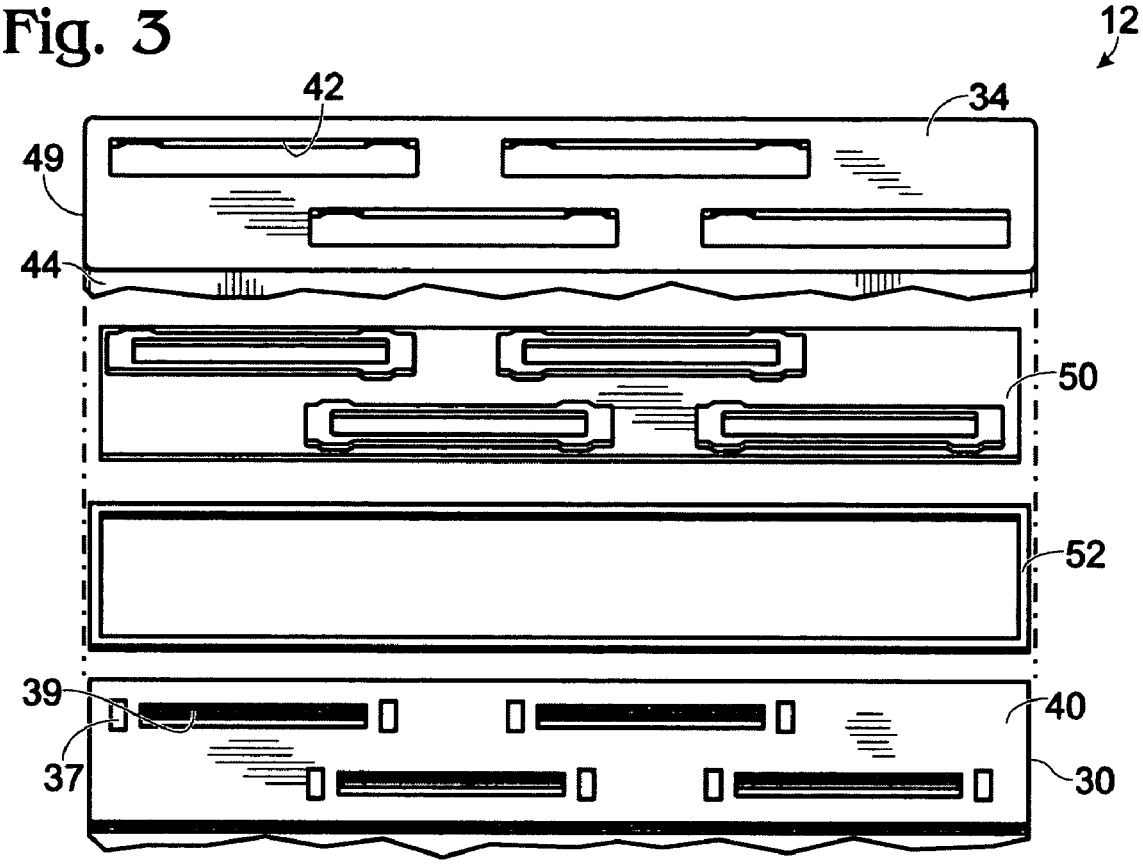
FIG. 3 is an exploded view of a portion of the embodiment of FIG. 2, with the fluid ejection dies omitted.

FIG. 2 shows an exemplary embodiment of fluid ejection head assembly 12, and FIG. 3 shows an exploded view of a portion of the fluid ejection head assembly of FIG. 2. The depicted fluid ejection head assembly 12 is a wide-array assembly. Fluid ejection head assembly 12 includes a carrier 30 supporting a plurality of fluid ejection dies 32, and a cover 34 covering an upper surface and sides of carrier 30. Only a relatively thin section of carrier 30 is shown in FIG. 3, and the dies are omitted from FIG. 3 for clarity. While the depicted fluid ejection head assembly is a wide-array assembly with four fluid ejection dies, it will be appreciated that the fluid ejection head assembly may also be a single die assembly, or a wide-array assembly of any count.

Carrier 30 is configured to be connected to mounting assembly 18 and to couple fluid ejection head assembly 12 to the mounting assembly. Carrier 30 may also be configured to electrically connect fluid ejection mechanisms 16 on fluid ejection dies 32 to controller 22. Any suitable structure may be used to electrically connect fluid ejection dies 32 to controller 22. In the depicted embodiment (FIG. 5), carrier 30 includes a plurality of electrical contacts 36 disposed along a first side 38 of the carrier. Electrical contacts 36 are configured to contact a plurality of complementary contacts on mounting assembly 18 that are in electrical communication with controller 22 when the carrier is mounted to the mounting assembly. This permits the communication of power, ground and data signals from the controller to each die 32. While the depicted electrical contacts 36 are positioned on a side of carrier 30, it will be appreciated that the electrical contacts may be positioned at any other suitable location on the carrier.

Electrical contacts 36 are electrically connected to dies 32 via circuitry extending between the electrical contacts and the dies. The circuitry may take the form of vias (not shown) that extend through the interior of carrier 30 and/or along the surface of carrier 30. Carrier 30 also typically includes a second set of electrical contacts, shown at 37 in FIG. 3, that terminate the vias for electrically connecting the dies to the circuitry on carrier 30. It will be appreciated that the circuitry and electrical contacts may exist as separate subcomponents or parts, such as a printed circuit board or other layered circuit device and other connection devices, and pre-assembled to create carrier 30.

Carrier 30 also may be configured to function as a manifold to distribute printing fluids to dies 32. Thus, carrier 30 may include channels configured to deliver the fluid to each die. These channels are depicted at 39 in FIG. 3.

Dies 32 are configured to transfer fluids received from fluid reservoir 26 onto printing medium 14. Dies 32 are mounted to a top side 40 of carrier 30, and are aligned in one or more rows. In the depicted embodiment, dies 32 are mounted in two rows, and are spaced apart and staggered such that the dies in one row at least partially overlap the dies in the other row. This arrangement of dies 32 allows fluid ejection head assembly 12 to span any desired width, for example, a nominal page width.

Cover 34 is configured to fit over side 40 of carrier 30, and includes an opening 42 for each die 32 to allow fluids ejected by the dies to reach printing medium 14. Cover 34 also may include one or more sides 44 that at least partially cover the sides of carrier 30. One or more notches 46 may be provided in sides 44 of cover 34 to mate with one or more corresponding protrusions 48 on carrier 30. The interaction of notches 46 and protrusions 48 may assist in the manufacture of fluid ejection head assembly 12, as described in more detail below.

Cover 34 may be configured to provide a smooth, level surface to assist in the cleaning of fluid ejection head assembly 12 in a wiping station. For example, cover 34 may be configured to have rounded or chamfered corners 49 and/or a non-abrasive surface to minimize wear caused to the wiper in the wiping station. Furthermore, cover 34 may be configured to mount to carrier 30 such that the outer surface of cover 34 is approximately coplanar with the outer surfaces of dies 32. This configuration may allow the surfaces of dies 32 and cover 34 to be cleaned simultaneously, while reducing the risk of failing to clean residues located adjacent the boundary between the cover and dies.

Cover 34 may be separated from the surfaces of carrier 30 by a small space, and the space may be filled with a filler material. The filler material is shown at 50 in FIG. 3. Filler layer 50 may help to protect the electrical interconnects between dies 32 and electrical contacts 36 from damage caused by the wiper or by fluid contamination, and also may help hold dies 32 in place on carrier 30. Furthermore, filler layer 50 occupies the space between dies 32 and the edges of openings 42 in cover 34 to help level the surface of fluid ejection head assembly 12 for wiping. Filler layer 50 may exist as one interconnected volume per fluid ejection device or as several smaller volumes. Filler layer 50 may be made from any suitable material. Suitable materials include those that are electrically insulating and/or resistant to corrosion by printing fluids.

Cover 34 may be attached to carrier 30 in any suitable manner. In the depicted embodiment, cover 34 is attached to carrier 30 with a bead of adhesive, shown at 52 in FIG. 3. Any suitable adhesive may be used. In some embodiments, an adhesive curable with electromagnetic radiation may be used to attach cover 34 to carrier 30. In these embodiments, cover 34 may be made of a material or materials that are at least partially transparent to the wavelength of radiation used to cure adhesive 52.

An exemplary method of attaching cover 34 to carrier 30 via an electromagnetic radiation-curable adhesive is as follows. First, adhesive 52 is added to side 40 of carrier 30. In the depicted embodiment, the bead of adhesive 52 generally follows the perimeter of side 40 of carrier 30, but it will be appreciated that the adhesive may be added to the carrier in any other suitable pattern. Next, cover 34 is placed over carrier 30 such that the cover is in contact with adhesive 52. After placing the cover over carrier 30, adhesive 52 is cured by illuminating the cover with radiation of a suitable wavelength. The radiation is transmitted through the cover and activate the adhesive, which cures the adhesive. Typically, the filler layer 50 is added to the space between cover 34 and carrier 30 after curing adhesive 52. An exemplary method of manufacturing fluid ejection head assembly 12 utilizing this process is described in more detail below.

Any suitable electromagnetic radiation-curable adhesive may be used as adhesive 50. For example, adhesives cured by radiation in the visible spectrum may be used. However, these adhesives may need to be applied in the absence of substantial amounts of visible light. Adhesives cured by radiation in the ultraviolet (UV) spectrum may also be used. These adhesives may be applied under ordinary visible light conditions, and thus may be easier to work with than adhesives activated by visible light. Any suitable UV-curable adhesive may be used. One example of a suitable adhesive is that which is sold under the product name Amicon UV-307, by Emerson and Cuming, Inc. of Canton, Mass.

Cover 34 may be made of any suitable material. Suitable materials may include those that have reasonable dimensional stability, and/or that are resistant to printing fluids and any cleaning fluids used at a servicing station. Suitable materials may also include those that shed few particles during wiping, and/or that are electrically insulating to help prevent shorts caused by printing fluids. Furthermore, suitable materials may include those that transmit wavelengths of radiation used to cure adhesive 52, and that possess a coefficient of thermal expansion similar to that of carrier 30 to help prevent problems caused by different rates of thermal expansion. In one example, mineral-filled LCP is used. Also, where a UV radiation-curable adhesive is used to join cover 34 to carrier 30, cover 34 may be made of a material that can be colored with a suitable pigment or dye to make the cover opaque. Examples of suitable materials possessing at least some of these properties are polysulfones and polybutylene terephthalates, which are UV-transparent and may be colored with pigments and/or dyes. These materials also may be injection molded, and thus may allow a cover having all desired internal and external structures to be formed via a single-step molding process.

Cover 34 may have any suitable thickness. In some embodiments, the thickness of cover 34 may be selected as a function of the thickness of the die, adhesive bead 52 and filler layer 50 so that the outer surface of the cover is approximately flush with the outer surfaces of dies 32. For example, where the thickness of a die 32 is approximately 980 microns and the thickness of adhesive 52 is 102 microns, cover 34 may be approximately 980–102=878 microns. Furthermore, cover 34 may have a thickness in a range around this number, for example, from approximately 980 microns to approximately 850 microns, or a value outside of this range.

Figure 4:
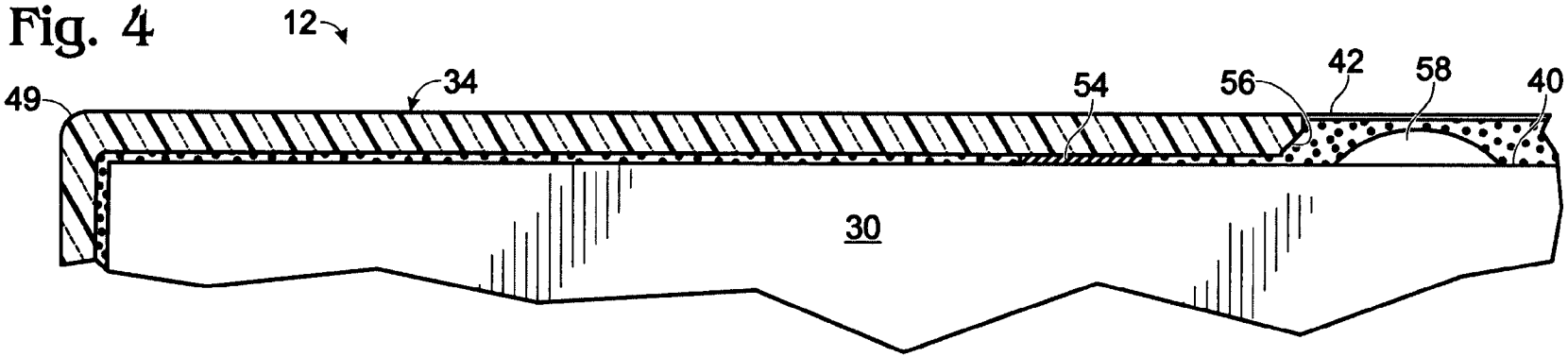
FIG. 4 is a sectional side view of the embodiment of FIG. 2, taken along line 4—4 of FIG. 2.

Cover 34 may include one or more standoffs to space the cover a desired distance from the surface of carrier 30. The use of standoffs may allow the thickness of filler layer 50 to be set with more precision than where standoffs are not used. One example of a suitable standoff is shown at 54 in FIG. 4. Standoff 54 takes the form of a protrusion molded into the surface of cover 34 that is adjacent side 40 of carrier 30. Standoff 54 contacts the surface of carrier 30, and holds the surrounding portions of cover 34 spaced from the surface of the carrier. Typically, cover 34 includes a plurality of standoffs located across the area of the cover to support substantially all portions of the cover over the carrier, but may also include only a single standoff.

During manufacturing, dies 32 are typically mounted to carrier 30 via small spots of a tack adhesive 58 placed at locations where the corners of the dies are to be positioned before filler layer 50 is formed. Cover 34 may include one or more cutouts, shown at 56 in FIG. 4, to help prevent cover 34 from contacting the tack adhesive, and thus help to ensure that cover 34 is positioned at the correct height relative to side 40 of carrier 30.

Cutouts 56 may have any desired shape. In the depicted embodiment, cutouts 56 have a rounded shape, but other shapes, including but not limited to square, trapezoidal, triangular, and other polygonal shapes, may also be suitable. The depicted cutouts 56 do not extend through the entire thickness of cover 34, but instead take the form of thinned regions formed in the surface of the cover that faces surface 40 of carrier 30. Alternatively, cutouts 56 may extend through the entire thickness of cover 34.

Figure 5:
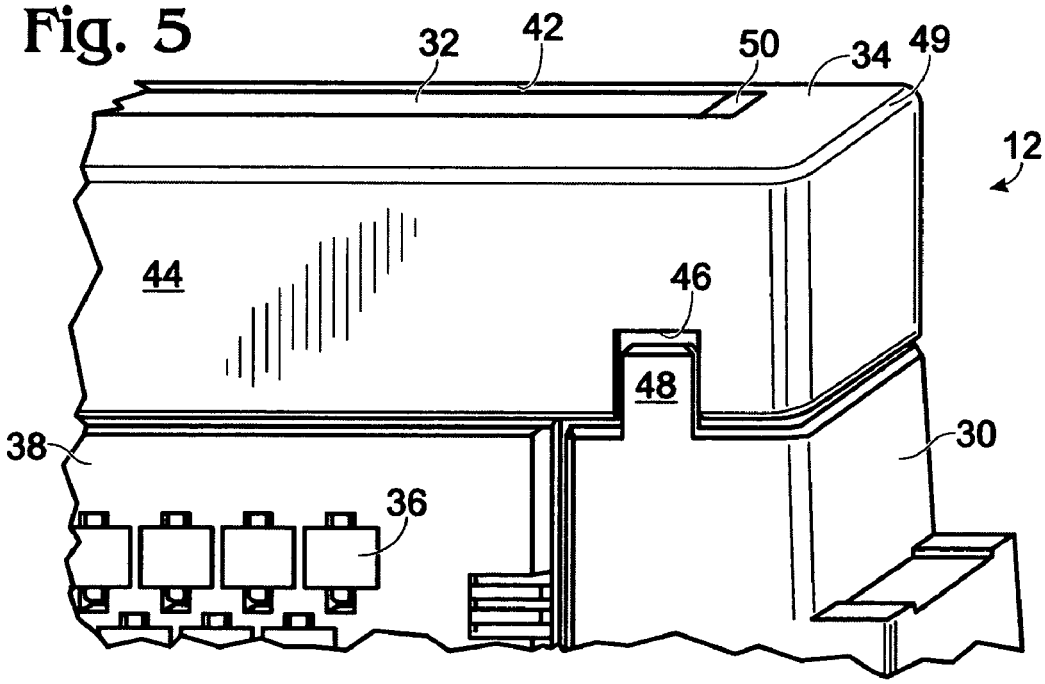
FIG. 5 is a side view of a portion of the embodiment of FIG. 2, showing a protrusion on the carrier situated within a notch on the cover.

As described above, cover 34 may include notches 46 configured to mate with protrusions 48 formed in the side of carrier 30. In some embodiments, notches 46 may be configured to thermally tack cover 34 to carrier 30 during the curing of adhesive 52. FIG. 5 shows an exemplary notch 46 and protrusion 48 in more detail. Holding cover 34 in place on carrier 30 may be sufficiently strong to prevent the cover from moving relative to the carrier during the curing process.

As described above, after curing adhesive 52 to join cover 34 to carrier 30, filler layer 50 may be formed between cover 34 and carrier 30. Filler layer 50 may be formed by adding a curable filler material to the space between cover 34 and carrier 30 in a flowable state, and then curing the curable material. To help prevent overfilling or underfilling the space between cover 34 and carrier 30 with the curable filler material, curable material detection pockets may be provided for monitoring the level of the curable filler material as the material is added to the space between cover 34 and carrier 30.

Figure 6:
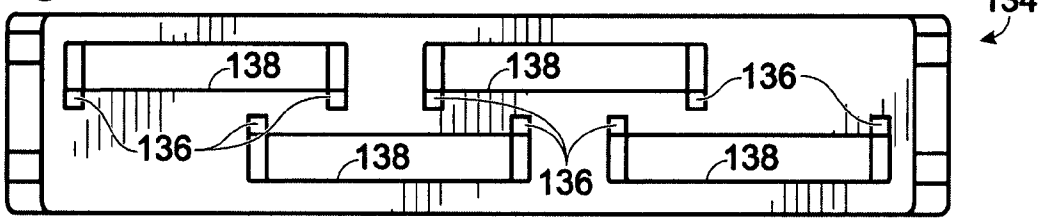
FIG. 6 is a top view of the embodiment of a fluid ejection head cover according to another embodiment of the present invention.
Figure 7:
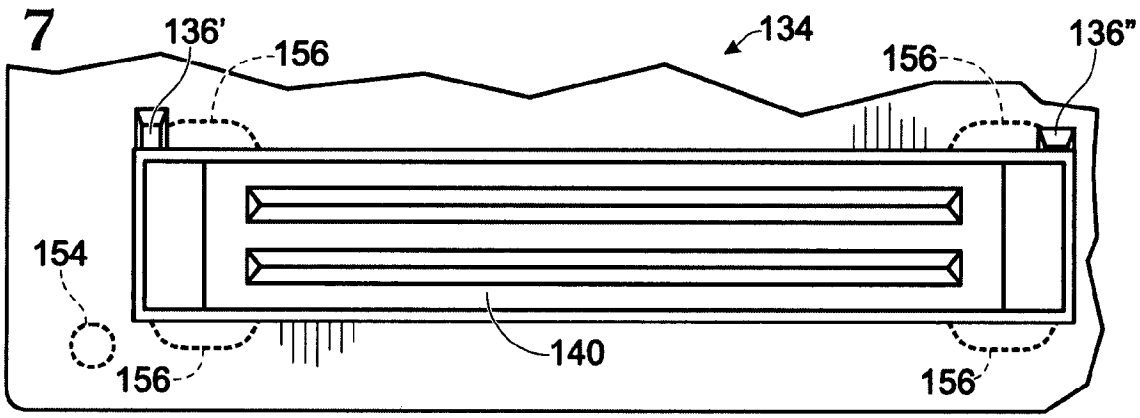
FIG. 7 is a magnified top view of a portion of the embodiment of FIG. 6.

FIG. 6 shows a top view of a cover 134 having a first exemplary arrangement of curable material detection pockets 136, and FIG. 7 shows the curable material detection pockets in more detail. FIG. 7 also shows a standoff 154 configured to space the cover from the top surface of the carrier. Pockets 136 may take the form of depressions formed in the outer surface of the cover. As the filler material fills the space between the cover and the carrier, the filler material flows into the detection pockets. This allows the level of filler material to be more easily monitored during manufacturing.

Cover 134 may have as many curable material detection pockets 136 as desired. For example, cover 134 may have only a single curable material detection pocket 136, or may have one or more curable material detection pockets for each opening 138 in cover 134 (openings 138 correspond to openings 42 of the embodiment of FIG. 2). In the embodiment of FIGS. 6 and 7, cover 134 includes two curable material detection pockets 136 for each opening 138 in cover 134. This arrangement may allow the level of curable filler material around each die 140 to be monitored to ensure that filler layer 50 sufficiently encapsulates the electrical leads connecting each die to the carrier to protect the leads from electrical shorts, etc.

Curable material detection pockets 136 may have any suitable shape and size. For example, curable material detection pockets 136 may have a bottom surface oriented approximately parallel to the outer surface of cover 34, as shown at 136', or may have a sloped bottom surface, as shown at 136". Furthermore, the outer perimeter of curable material detection pockets 136 may have any desired shape. The detection pockets depicted in FIGS. 6 and 7 each have a rectangular perimeter. However, it will be appreciated that the pockets may also have a rounded perimeter, or other shape. Detection pockets 136 may also overlap to some degree with the cutouts 156 used to accommodate the adhesive tack dots described above.

Figure 8:
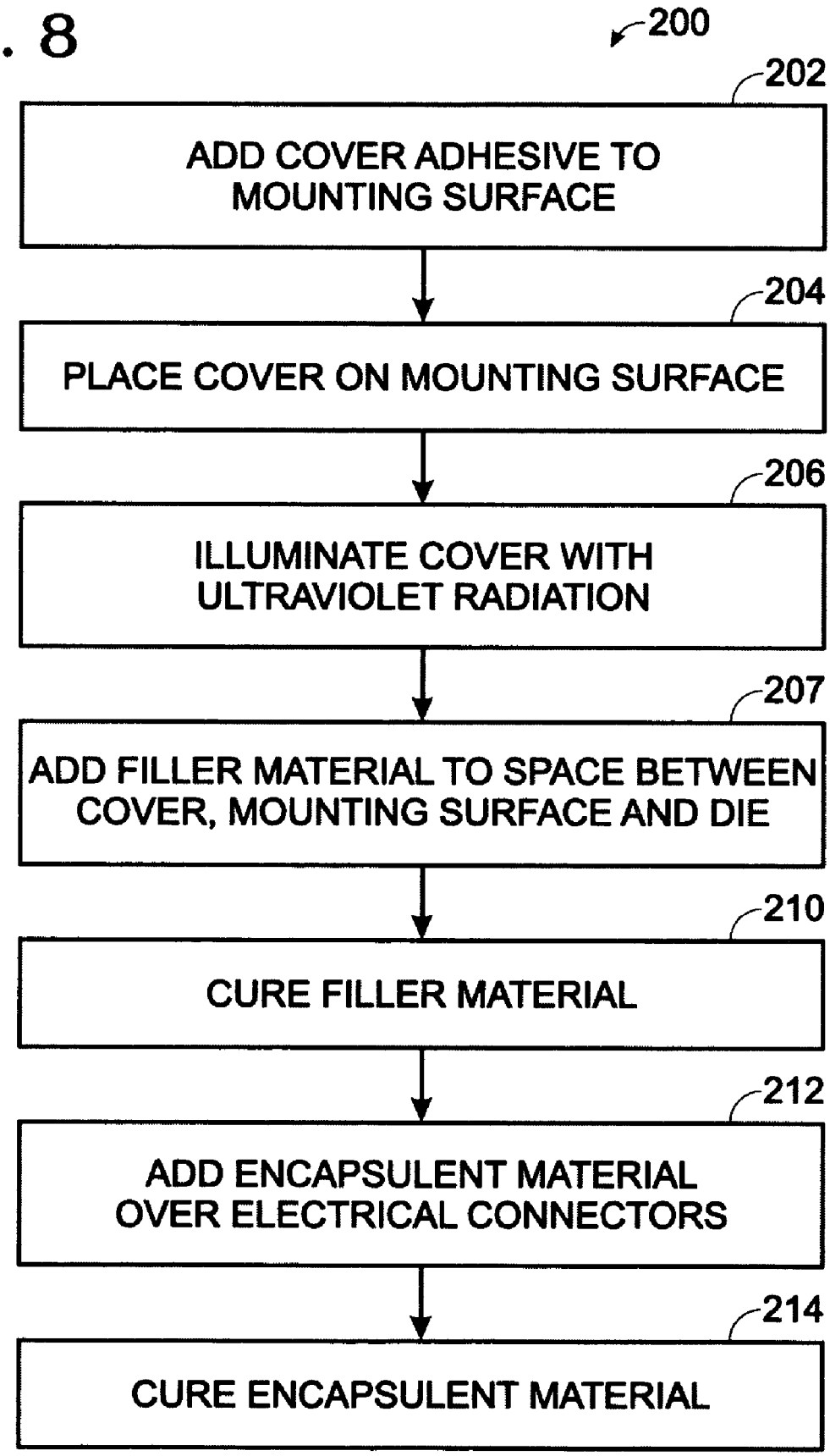
FIG. 8 is a flow diagram showing a method of manufacturing a fluid ejection head for a fluid ejection device according to an embodiment of the present invention.

FIG. 8 shows, generally at 200, a method of manufacturing a fluid ejection head assembly according to another embodiment of the present invention. Method 200 includes first adding, at 202, an adhesive to a substrate or mounting surface to which a fluid ejection head cover will be mounted. For example, in the embodiment of FIGS. 1–5, the substrate or mounting surface corresponds to surface 40 of carrier 30, but it will be appreciated that other embodiments may have different mounting surfaces other than that which supports fluid ejection dies. Typically, the dies will already be mounted on the carrier via dots of a tack adhesive before the adhesive for joining the cover to the mounting surface is added at 202, but the dies may also be mounted after the cover is joined to the mounting surface.

Next, the fluid ejection head cover may be placed, at 204, on the mounting surface such that it is in contact with the uncured adhesive. The cover is then illuminated with electromagnetic radiation at 206 to cure the adhesive, thus bonding the cover to the mounting surface. Where the carrier includes protrusions that mate with notches on the cover, mechanically deforming the adjacent surfaces or engaging snaps or other suitable interference features will hold the cover in place on the carrier.

After curing the adhesive at 206, the curable filler material is added, at 208, to the space between the cover and the mounting surface to potentially protect the electrical connectors and leads from fluid residue and humidity, and to hold the dies in place more securely. Where the cover includes curable material detection pockets, the level of the filler material may be monitored via the pockets during or after the addition of the material. After the filler material has been added to a desired level, the filler material may be cured at 210. The method used to cure the filler material may differ depending upon the curable material used as the filler. Suitable methods include, but are not limited to, thermal cures, chemical cures and electromagnetic cures.

Typically, the electrical connector pads on each die for connecting power, ground and data lines to the dies are located on, or inset slightly below, the surface of fluid ejection head assembly 12 that is wiped at a servicing station. Therefore, the interconnects (not shown) connecting these pads to the connectors 37 on the carrier may extend slightly above the outer surfaces of cover 34, filler layer 50 and dies 32. To protect these interconnects from damage caused by cleaning processes and from electrical shorts caused by contamination with fluids, the interconnects and the contact pads on the dies may be covered, at 212, with a suitable encapsulant material. The encapsulant material may then be cured, at 214, to protect the interconnects and contact pads on the dies.

Although the present disclosure includes specific embodiments, specific embodiments are not to be considered in a limiting sense, because numerous variations are possible. The subject matter of the present disclosure includes all novel and nonobvious combinations and subcombinations of the various elements, features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A fluid ejection head for a fluid election device, the fluid ejection head comprising:

a substrate;

a fluid ejection die coupled with the substrate;

an electromagnetic radiation-curable adhesive disposed on the substrate; and a cover coupled with the substrate via the electromagnetic radiation-curable adhesive, wherein the cover includes an opening configured to receive the fluid ejection die therein so as to permit passage of fluids ejected from the fluid ejection die therethrough, and wherein the cover is made at least partially of a material transparent to electromagnetic radiation.

2. The fluid ejection head of claim 1, wherein the adhesive is an ultraviolet radiation-curable adhesive.

3. The fluid ejection head of claim 2, wherein the cover is made of a material at least partially transparent to ultraviolet radiation.

4. The fluid ejection head of claim 3, wherein the material at least partially transparent to ultraviolet radiation is opaque to visible radiation.

5. The fluid ejection head of claim 1, wherein the material capable of transmitting electromagnetic radiation is selected from the group of materials consisting of polysulfones and polybutylene terephthalates.

6. The fluid ejection head of claim 1, wherein the substrate includes a top and peripheral sides, and wherein the cover includes sides configured to at least partially cover the peripheral sides of the substrate.

7. The fluid ejection head of claim 1, wherein the cover includes a standoff configured to be in contact with the substrate to space other portions of the cover from the substrate.

8. The fluid election head of claim 1, wherein the cover includes a notch coupled with a complementary protrusion on the substrate.

9. The fluid ejection head of claim 8, wherein the cover includes a plurality of notches coupled with a plurality of complementary protrusions on the substrate.

10. The fluid ejection head of claim 8, wherein the notch is configured to clamp the complementary protrusion when heated due to thermal expansion.

11. The fluid ejection head of claim 1, further comprising a filler material disposed between the substrate and cover.

12. A fluid ejection head for a fluid ejection device, the fluid ejection head comprising:

a substrate;

a fluid ejection die coupled with the substrate;

an electromagnetic radiation-curable adhesive disposed on the substrate;

a cover coupled with the substrate via the electromagnetic radiation-curable adhesive, wherein the cover includes an opening configured to pass fluids ejected from the fluid ejection die, and wherein the cover is made at least partially of a material transparent to electromagnetic radiation; and a filler material disposed between the substrate and cover, the cover having an outer surface wherein the cover includes a recess open to the outer surface of the cover into which filler material flows when the filler material is added between the substrate and cover.

13. The fluid ejection head of claim 12, wherein the recess is formed in an edge of the opening of the cover.

* * * * *

UNITED STATES PATENT AND TRADEMARK OFFICE

CERTIFICATE OF CORRECTION

PATENT NO. : 7,188,925 B2
APPLICATION NO. : 10/769429
DATED : March 13, 2007
INVENTOR(S) : Benjamin H. Wood, III et al.

It is certified that error appears in the above-identified patent and that said Letters Patent is hereby corrected as shown below:

In column 7, line 47, in Claim 1, delete “election” and insert -- ejection --, therefor.

In column 8, line 24, in Claim 8, delete “election” and insert -- ejection --, therefor.

Signed and Sealed this

Twenty-first Day of April, 2009

John Doll

JOHN DOLL
*Acting Director of the United States Patent and Trademark Office*